US008265319B2

(12) United States Patent
Groset et al.

(10) Patent No.: US 8,265,319 B2
(45) Date of Patent: Sep. 11, 2012

(54) EXPANDABLE SPEAKER ASSEMBLIES FOR PORTABLE MEDIA DEVICES

(75) Inventors: Erik Groset, Carlsbad, CA (US); Robin Michael Defay, Poway, CA (US)

(73) Assignee: Zipbuds, LLC, San Diego, CA (US)

( * ) Notice: Subject to any disclaimer, the term of this patent is extended or adjusted under 35 U.S.C. 154(b) by 1247 days.

(21) Appl. No.: 11/860,508

(22) Filed: Sep. 24, 2007

(65) Prior Publication Data

US 2009/0080684 A1 Mar. 26, 2009

(51) Int. Cl.
*H04R 1/02* (2006.01)

(52) U.S. Cl. ..... 381/334; 381/386; 381/388; 381/394; 455/575.1; 455/575.4; 455/90.3; 361/679.23

(58) Field of Classification Search ..... 381/394, 381/386–388, 332–334; 455/575.1, 575, 455/3, 575.4, 575.3, 90.3; 361/681, 683, 361/679.23, 678.29, 679.3
See application file for complete search history.

(56) References Cited

U.S. PATENT DOCUMENTS 5,528,946 A * 6/1996 Yadegar ..... 74/31
5,588,055 A 12/1996 Williamson et al.
6,491,194 B2 12/2002 Marvin
6,600,827 B2 * 7/2003 Lu ..... 381/388
6,647,248 B1 11/2003 Ortscheid et al.
6,794,798 B2 * 9/2004 Watanabe et al. ..... 310/334
7,230,822 B2 6/2007 Langberg et al.
2007/0014426 A1 * 1/2007 Sung et al. ..... 381/386
2007/0035917 A1 2/2007 Hotelling et al.
2009/0131127 A1 * 5/2009 Hung ..... 455/575.4

OTHER PUBLICATIONS

Webpage: http://www.cyanics.net/ipod.html. Unknown publishing date, 1 page.
Webpage: http://www.macally.com/EN/Product/ArticleShow.asp?ArticleID=207. Unknown publishing date, 3 pages.
Webpage: http://www.ilounge.com/index.php/reviews/entry/logic3-i-station-rotate-portable-speaker-for-iphone-ipod/. Jeremy Horwitz, "Logic3 i-Station Rotate Portable Speaker for iPhone + iPod", Dec. 23, 2008, 10 pages.
http://gizmodo.com/gadgets/iphone-dock/logic3-first-out-with-iphone+dedicated-speaker-system-289168.php, 3 pages.

* cited by examiner

*Primary Examiner* — Michael Trinh
(74) *Attorney, Agent, or Firm* — Mintz Levin Cohn Ferris Glovsky and Popeo, P.C.

(57) ABSTRACT

Speaker assemblies for portable media players are disclosed herein. Speaker assemblies can include means for contracting and expanding the speakers to facilitate viewing and listening to a PMP in multiple orientations. Preferred means for contracting and expanding the speaker casings are operably coupled with means for rotating the PMP, such that when the PMP is in a wide viewable configuration, the speakers are expanded.

13 Claims, 4 Drawing Sheets

EXPANDABLE SPEAKER ASSEMBLIES FOR PORTABLE MEDIA DEVICES

FIELD OF THE INVENTION

The embodiments herein relate to speaker accessories compatible for use with portable media players (PMPs) non-exclusively including smart phones, handheld game consoles, and digital audio and video players capable of storing and playing files in one or more media formats. More specific embodiments relate to speaker assemblies designed for use with portable media players that are configured to be used in multiple orientations.

BACKGROUND

Portable media players (PMPs) are handheld electronic devices that are capable of storing and playing files in one or more media formats. In general PMPs are configured to play audio and/or video files. Additionally, PMPs can also display image files, including pictures, spreadsheets, word processing documents, drawings, graphs, web pages, and the like. Data files are typically stored on a hard drive, microdrive, or flash memory within the PMP. Various portable media players include the ability to record video and audio, and some have built-in card readers like SD or MMC, which makes it convenient to upload media directly to the player, or the memory is used as extra capacity.

Typical video formats PMPs can be configured to play non-exclusively include MPEG, DivX, Xvid, AMV and SigmaTel Motion Video (SMV) files. Typical audio file formats PMPs can be configured to play, non-exclusively include MP3, WAV, Advanced Audio Coding (ACC) and Ogg Vorbis. Typical digital image formats PMPs can be configured to display non-exclusively include BMP, JPEG, PDF, and GIF, for example.

While most PMPs are capable of playing audio, because of their relatively small size and power needs, often times the speakers that are built into the PMP are inadequate, if they exist at all. Minimally powered, or small built-in speakers on a PMP make it difficult for multiple listeners to simultaneously enjoy an audio file. To address this issue, removable speaker assemblies for PMPs have been designed to allow multiple listeners to simultaneously hear an audio file.

One example of an existing speaker assembly configured for a PMP is provided in U.S. Pat. No. 7,230,822, to Langberg, et al, which is hereby incorporated by reference in its entirety. Unfortunately, the speaker assembly disclosed in Langber, et al., and other existing speaker assemblies, are configured for PMPs that display images and videos files in a single orientation. Recent technological developments in PMPs however, now allow for the screen to display images and video files in multiple orientations. Examples of PMPs that currently display images and video files in multiple orientations (e.g., vertical and horizontal or portrait and landscape) non-exclusively include Apple iPhone and Apple iPod Touch, for example.

Thus, there is a need in the art for releasably attached speaker assemblies configured to work with PMPs that display images and/or video in multiple orientations. Accordingly, one object of the teachings herein is to provide a releasably attachable speaker assembly operably coupled to a PMP that can operate while the PMP is positioned in a plurality of orientations. More specifically, in advantageous embodiments, the teachings herein are directed to speaker assemblies that can expand past the coupled PMP in its widest orientation such that the body of the PMP does not significantly block, or overlap the speakers. Further objects of the invention, allow for a compact speaker assembly that is collapsible and expandable, to make it easier for the user to handle and transport. More specifically, in preferred embodiments the speaker assemblies provided herein can be configured to have the same, or substantially the same, height and width as the attached PMP, or even smaller.

SUMMARY OF THE INVENTION

Embodiments herein are directed to speaker assemblies having a housing configured to utilize a power source and being operably connected to 1 or more speakers having means for expanding and contracting, and further including means for releasably attaching and operably coupling to a portable media player (PMP), such that audio can be transmitted from the PMP through the 1 or more speakers. More specifically, speaker assemblies herein can include means for releasably attaching to said PMP that are configured to rotate, such that a user can view the PMP in multiple orientations In further embodiments, the means for expanding and contracting are operably coupled to said means for releasably attaching to said PMP, such that the speakers are configured to expand and contract based on the rotation of the PMP. In further embodiments, the means for releasably attaching to said PMP are operably coupled to a rotating central gear within the housing that is configured to expand and contract the speakers based upon clockwise or counter-clockwise rotational direction. Additionally, the gear can include two toothed quadrants positioned on opposite sides from each other and are complementary to toothed sections on extension arms coupled to 1 or more speakers. Additionally, the means for expanding and contracting can be configured to expand the 1 or more speakers to a position beyond the body of the PMP and contract the 1 or more speakers to a position behind the body of the PMP.

Additional embodiments relate to speaker assembly having a housing configured to utilize a power source and being operably connected to 1 or more speakers having means for expanding and contracting, and further including means for releasably attaching and operably coupling to a portable media player (PMP) having a substantially rectangular screen that can display video or images in both a vertical and horizontal orientation, such that data can be transmitted from the PMP through the 1 or more speakers. In other embodiments, the means for releasably attaching to said PMP can be configured to rotate, such that a user can view the PMP in both said vertical and horizontal orientation. Further means for expanding and contracting are operably coupled to the means for releasably attaching to said PMP, such that the speakers are configured to expand and contract based on the rotation of the PMP.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below with reference to the above described Figures. It is, however, expressly noted that the present invention is not limited to the embodiments depicted in the Figures, but rather the intention is that modifications that are apparent to the person skilled in the art and equivalents thereof are also included.

Figure 1:
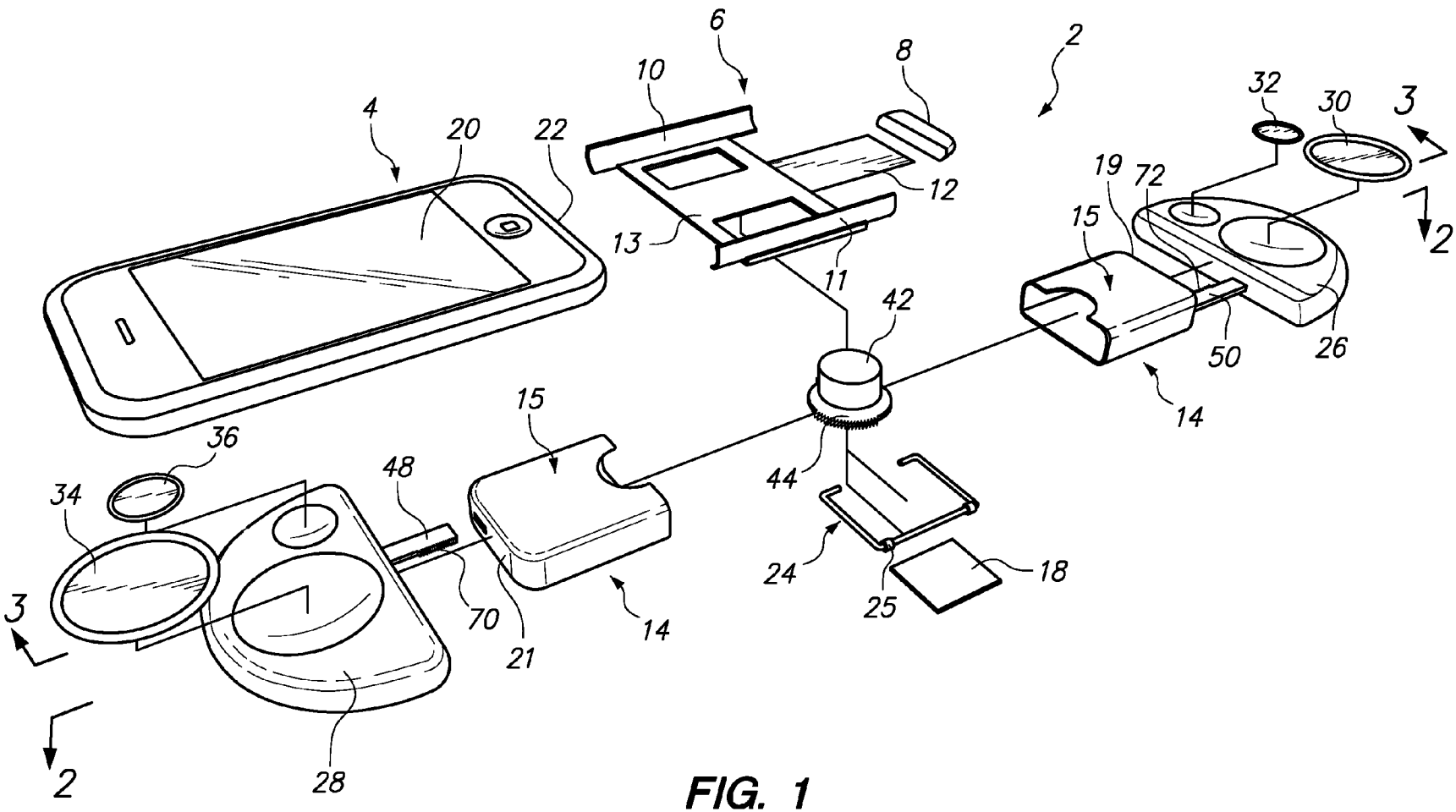
FIG. 1 is an exploded view of one embodiment of a speaker assembly.

FIG. 1 depicts an exploded view of a preferred speaker assembly 2 that is configured to be used with a PMP 4. The speaker assembly 2 preferably includes a cradle 6 configured to hold the PMP 4 and connect to a main housing 14. In advantageous embodiments, the cradle 6 includes a backing 13 and first and second parallel sides 10 and 11 configured to wrap around parallel sides of the PMP 4. While the cradle 6 can be configured to hold any desired PMP, in more preferred embodiments, the first and second sides 10 and 11 and the backing 13 of the cradle 6 are configured to hold a PMP 4 having a height of 4.5 inches, width of 2.4 inches, and a depth of 0.46 inches, such as an Apple iPhone. In other preferred embodiments, the first and second sides 10 and 11 of the cradle 6 are configured to hold a PMP 4 having a height of 4.3 inches, width of 2.4 inches and a depth of 0.31 inches, such as an Apple iPod Touch. Other advantageous cradles 6 can be configured to hold PMPs having heights between 4 to 5 inches, widths between 2 to 4 inches, and depths between 0.2-0.75 inches. Cradles that have adjustable means for retracting and contracting, such that they can hold differently sized PMPs are also expressly contemplated herein.

Other means, beside the cradle 6 depicted in FIG. 1, for releasably securing the PMP 4 while operably coupled to the speaker assembly 2 are expressly contemplated herein, and non-exclusively can include magnets, snaps, clips, latches, and the like, depending on the specifications of the PMP.

In other preferred embodiments, the means for releasably securing the PMP can include a connector 8 configured to receive and operably couple with the PMP 4. In more specific embodiments, the connector 8 can be attached to the cradle backing 13 by an extension plate 12, configured to hold the PMP 4 securely within the sides 10 and 11 of the cradle 6 such that the connector 8 is in operable connection to the PMP port 22. In preferred embodiments, the extension plate 13 can also provide support to the back of the PMP 4. Means for operably coupling the PMP 4 to the speaker assembly 2 can also include wireless means.

The connector 8 can serve multiple functions, non-exclusively including transferring power into the PMP 4 and transferring data from the PMP 4 to the speakers 30, 32, 34, and 36. The power and data transfer through the connector 8 and the PMP 4 (e.g., complementary port) can be embodied in various forms and combinations including contact based and non-contact based platforms. By way of example, contact based platforms may include electrical contacts that are capable of transferring data and/or power when the electrical contacts between the PMP 4 and the connector 8 are electrically engaged or in contact with one another. Non-contact based platforms, on the other hand, may include inductive devices, optical devices, or wireless devices that are capable of transferring data and/or power without mating contact. In preferred non-exclusive embodiments, the connector 8 is configured to operably couple with an Apple iPod Touch and an Apple iPhone. The speaker assemblies 2 provided herein can include connectors 8 that are in contact and/or non-contact communication with the PMP 4, and can include contact and/or non-contact communication means for transferring the data from the PMP 4 to the speakers 30, 32, 34, and 36.

Preferred means for coupling the PMP 4 to the speakers 30, 32, 34, and 36 involve speaker wires, but can be wireless. While shown in the Figures as crescent shaped, the speaker casings herein can be any suitable shape, non-exclusively including substantially square, rectangular, circular or oval, for example. Preferred embodiments include speaker casings that do not extend past the body of the PMP 4 in a contracted state, or do not substantially extend past the body of the PMP 4 in a contracted state. Likewise preferred speaker casings 26 and 28 are configured to be able to expand, such that the speakers 30, 32, 34, and 36 are not blocked, or are minimally blocked, by the PMP 4, cradle 6, or connector 8.

While the Figures depict the left and right speaker 26 and 28 casings individually housing 2 speakers 30, 32 and 34, 36, those with skill in the art will readily appreciate having 1, 3, 4, or more speakers in each casing 26 and 28.

Additional ports, such as those supporting a Universal Serial Bus, Fire Wire, and the like, can be added to the speaker assembly 2, preferably on the main housing 14 or speaker casings 26 and 28. Such connectors can allow the speaker assembly to have docking station functionality thus enabling the portable media device to transfer files with another computer, PMP, and the like. Further preferred ports on the speaker assembly 2 can support a 3.5 mm, 2.5 mm, or other sized headphone jack. As PMPs 4 often include their own port for a headphone jack, it is preferred that speaker assemblies 2 provided herein, including the connector 8, are configured to not engage or block said port, or other ports on the PMP 4 except the connector port 22.

In preferred embodiments, the speaker assemblies 2 provided herein include a housing 14 that is in operable connection with the cradle 6 and first and second expandable speaker casings 26 and 28 and supports a power source 16. According to preferred embodiments, the speaker assemblies 2 disclosed herein are configured to utilize a battery power source 16 and do not have means for plugging into an electrical outlet. In other embodiments, it is contemplated that speaker assemblies 2 provided herein can include means for plugging into an electrical outlet (e.g., AC current). Further speaker assemblies can be configured to utilize both a battery power source and an electrical outlet. This embodiment can be especially advantageous if the user does not have batteries available or if the speaker assemblies 2 are using rechargeable batteries that are configured to be charged while the speaker assembly 2 is plugged into an electrical outlet.

In preferred embodiments, the power source 16 is 1, 2, 3, 4, 5, or 6 batteries. In preferred embodiments, the speaker assemblies 2 described herein can be powered by 1 or more alkaline batteries, including but not limited to D, C, AA, and AAA, PP3 batteries. In other embodiments, 1 or more 9 volt alkaline batteries can be used as a power source.

In other advantageous aspects, 1 or more lithium batteries can be used to power the speaker assemblies 2 herein. Non-exclusive examples of lithium batteries that can be used with the teachings herein include lithium thionyl chloride batteries, and lithium manganese oxide batteries, and the like. In advantageous embodiments, 1 or more 6 Volt or 3 Volt lithium batteries can used to power the embodiments described herein. In still further embodiments, 1 or more 3.5 Volt, AA, 2.1 AH rated lithium batteries can be used as a power source. Those with skill in the art can readily select an appropriate power source 16 that is compatible with the power requirements of the speaker assembly 2 used. In further aspects, rechargeable batteries can be used to power the speaker assemblies 2 described herein. In additional embodiments, nickel-cadmium batteries can be used as a power source 16.

The speaker assemblies 2 herein can preferably include one or more of the following: means for controlling a power source such as an ON/OFF switch, means for controlling the volume, means for amplifying the sound (e.g., anti-static protected amplifier), means for adjusting the balance of sound, means for adjusting the treble and/or bass, and means for remote control operation, for example (not shown). These features are well known in the art of speakers and stereos, and their respective circuitry and electronics can readily be implemented with the teachings herein. Preferably, the above features can non-exclusively be located externally on the housing 14 or on the speaker casings 26 and 28 to be accessible to the user. The above features can also be readily implemented in a remote control configured to work with said speaker assemblies 2. Alternatively, the speaker assemblies 2 herein can be controlled through the PMP 4 alone or through the PMP 4 in conjunction with controls on the speaker assembly 2. In other embodiments the speaker assemblies 2 provided herein do not have an ON/OFF switch; for example, they could have a sensor that automatically detects an audio signal from the PMP 4. This specific embodiment allows the user to preserve power.

Preferably, the speaker assemblies 2 herein can be configured to use means for minimizing static such that the PMP 4 can be operated in its normal functioning mode. Non-exclusive means for minimizing static can include shielding the amplifier, surrounding the amplifier in aluminum and grounding it, shielding the signal wire and grounding the signal wire, and utilizing plastic-metallic shielding, and the like, for example.

Figure 6:
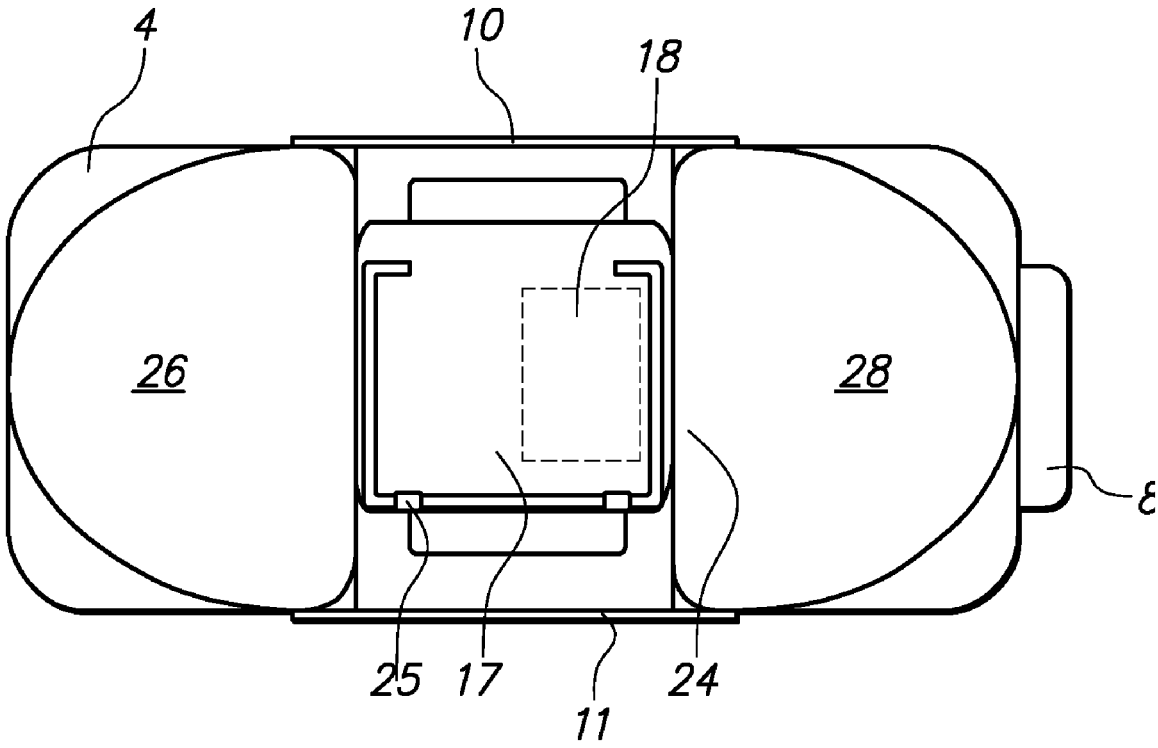
FIG. 6 is an orthogonal back view depicting the back of a preferred speaker assembly in a contracted state and operably coupled to a PMP in a starting horizontal position.

The housing 14 preferably has a front side 15 facing the back of the cradle 13 and back side 17 that preferably includes a stand 24 or other means for supporting the speaker assembly 2 and attached PMP 4 in a desired position on a flat surface, such as a cabinet, table top, bookshelf, and the like. In more preferred embodiments, the stand 24 is configured such that it can support the speaker assembly 2 and attached PMP 4 in both a vertical and horizontal, and expanded and contracted position. As depicted in FIG. 6, the stand 24 is preferably a wire-frame, having a U-square shape, as depicted in FIG. 1. Preferred stands 24 will be made of metal or plastic and have padding (e.g., rubber grommets) 25 to prevent scratching and slipping on the support surface. In even more preferred embodiments, the stand 24 can non-hinged or hinged to the back side 17 of the housing, such that it folds outward when used to support the speaker assemblies 2 provided herein. Hinged stands 24 can be folded against the back side 17 of the housing 14 when not used as a support means. Advantageously, a latch, lock, snap, tab, molding on the backside 17 of the housing, or other releasable means can secure the latch to the back side 17. Complementary molding in the shape of the stand 24 positioned on the backside 17 is especially advantageous as it allows the stand 24 to be flush against the backside 17 of the housing 14, when not in use. When supporting the speaker assemblies 2 with or without an attached PMP 4, it is preferred that the stand 24 is positioned at or between 40-89.5 degrees with respect to the backside 17 and the support surface. Means for holding the stands 24 such as latches, snaps, and the like, can also be used to maintain a stand 24 at a desired angle, such as at 44.5 degrees, and/or 89.5 degrees, for example.

In other embodiments, the back side 17 of the housing 14 can include means for hanging the speaker assembly 2 and attached PMP 4 on a hook, nail, and the like, for example. (not shown) Preferred hanging means include 1 or more wire, metal, or plastic loops configured to hang the speaker assembly 2 and PMP 4 substantially level on a wall.

In other advantageous embodiments, the back side 17 of the housing preferably includes a hinged or removable panel 18 for removing and inserting a power source 16 (e.g., 1 or more batteries). These types of panels 18 are well known in the art and can be closed by the use of tabs, latches, snaps, slots, and the like, for example.

In further embodiments, the housing 14 is in operable connection with 1 or more speaker casings 26 and 28. Preferably, the housing 14 is coupled to a right and left speaker casing 26 and 28, that house 1 or more speakers. In preferred embodiments, the connector 8 can be operably wired to the housing 14 and the housing 14 can be operably wired to the speakers such that the sound from the PMP's 4 audio files can be transferred to the speakers 30, 32, 34, and 36. In other embodiments, this configuration is wireless, such that the connector 8 transfers a signal to the housing 14, which then transmits a signal to the 1 or more speakers 30, 32, 34, and 36. Other suitable means for transferring data from the PMP 4 to the 1 or more speakers are expressly incorporated herein.

Figure 3:
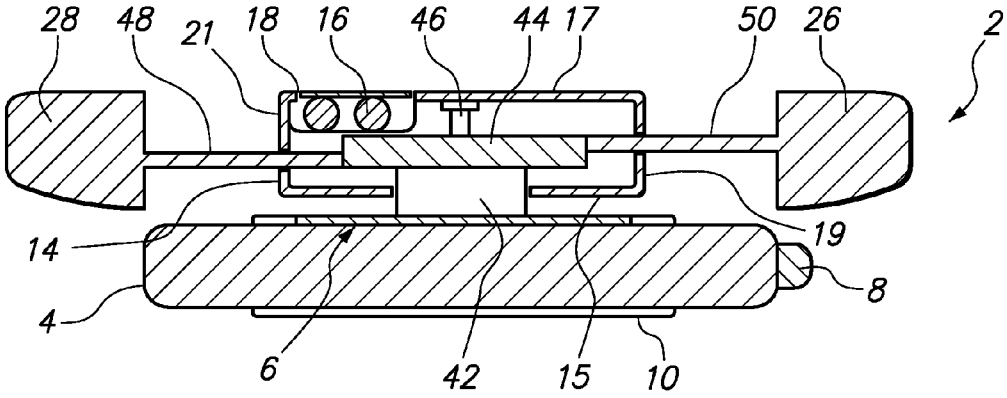
FIG. 3 is an orthogonal top view depicting the internal components of a preferred speaker assembly.

With reference to FIG. 3, the main housing 14 is preferably connected to the cradle 6 through a rotatable shaft 42 that extends through the front side 15. The shaft 42 can include a first end connected to the cradle's backing 13 through any suitable means, and can be a continuous piece of metal or plastic, for example. It is more preferred that the shaft 42 attaches to the center of the cradle's backing 13 for support. In further embodiments, it is preferred that when the cradle 6 rotates in a clockwise or counter-clockwise direction, the shaft 42 will rotate in the same direction. The shaft 42 preferably includes a second end that is attached to a central gear 44 located within the housing 14. This preferred configuration allows the central gear 44 to rotate in the same direction as the cradle 6. The central gear 44 is preferably attached to the housing's back side 17 by any suitable means, including an axle or a rotating shaft 46 threaded through the center of the gear 44.

Figure 2:
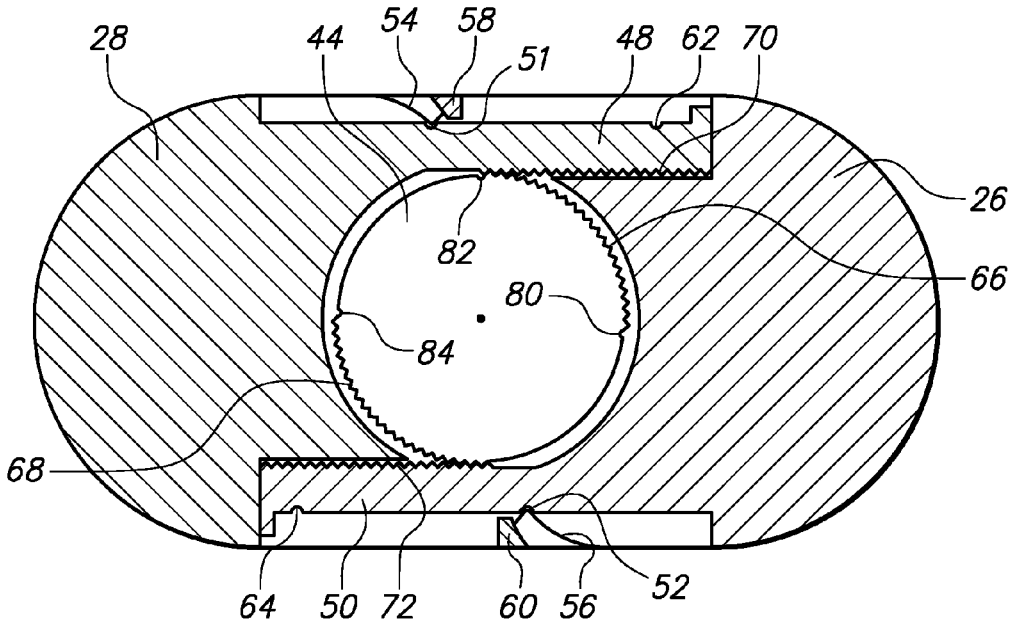
FIG. 2 is an orthogonal view depicting means to expand and retract a speaker assembly as an attached PMP rotates to different orientations.

Preferred means for expanding and contracting the speaker casings 26 and 28 involve a central gear 44. According to one embodiment, the gear 44 includes teeth 66 and 68 that are complementary to teeth 70 and 72 on a first and second extension arm 48 and 50. As depicted in FIG. 2, preferably the first extension arm 48 is positioned above the gear 44 and the second extension arm 50 is positioned below the gear 44.

Figure 4:
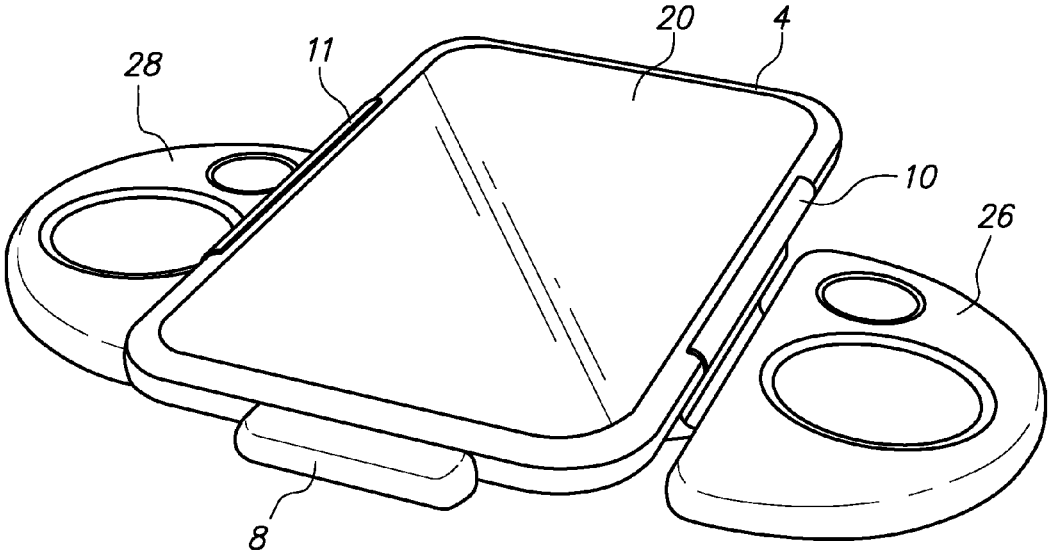
FIG. 4 is a perspective view depicting a preferred PMP in a vertical position.
Figure 5:
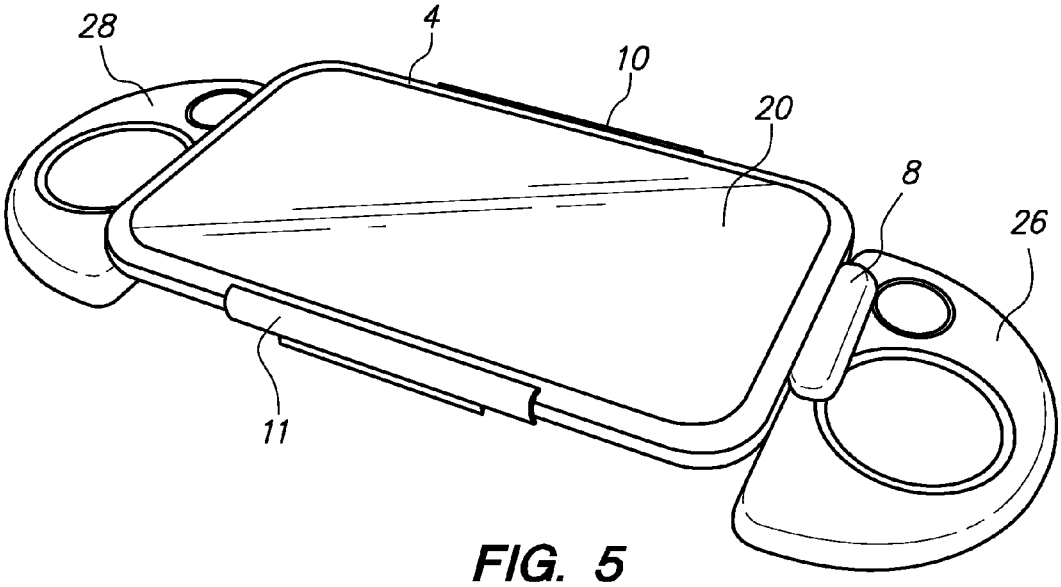
FIG. 5 is a perspective view depicting a preferred PMP in a working horizontal position.

FIG. 2 depicts a preferred internal gear/arm configuration, while the PMP 4 is in a vertical position, as depicted in FIG. 4. According to this particular embodiment, the speaker casings 26 and 28 are contracted and horizontally positioned on the sides of the PMP 4. As the user manually rotates the PMP 4 a quarter turn (90 degrees) counter-clockwise the teeth on the gear 66 and 68 engage with the complementary teeth 70 and 72 on the extension arms 48 and 50, and expand the speaker casings 26 and 28 outward, vertically. FIGS. 3 and 5 depict the PMP 4 in a working horizontal position, with the speaker casings 26 and 28 fully expanded and horizontally positioned on the sides of the PMP 4. The expansion of the speaker 26 and 28 casings is highly advantageous as it prevents the body of the PMP 4, the cradle 6, and the connector 8 from blocking, or significantly blocking, the speakers 30, 32, 34, and 36 in the working horizontal orientation, or in its widest configuration. Accordingly, the listener can enjoy the emitted sound waves from the speakers 30, 32, 34, and 36 without unnecessary interference from the body of the PMP 4, the cradle 6, and the connector 8. In more specific embodiments, the connector 8 is configured to not block the speaker casings 26 and 28 at all. In other embodiments, the connector 8 can be configured to block some of the speaker casing 26, but not the speakers 30 and 32 themselves. Conversely, the user can rotate the PMP 4 a quarter turn clockwise from the horizontal working position (as depicted in FIG. 5) and return the PMP 4 to a vertical position, thereby contracting the speaker casings 26 and 28.

Rotating the PMP 4 from a vertical to a working horizontal orientation is highly desirable depending on the visual orientation of the PMP screen 20 the user desires. If the user desires the PMP 4 in a narrow orientation, such as when space is limited, they can rotate the PMP 4 into a vertical position (See FIG. 4). Alternatively, if the user desires a wider screen to view video or images in a larger format, they can rotate the PMP 4 to a working horizontal position. The speaker assemblies 2 provided herein are highly advantageous as they allow the speaker casings 26 and 28 to be in operable communication with a PMP 4 in multiple working orientations (e.g., vertical and horizontal) without being obstructed by the body of the PMP 4, the cradle 6, or the connector 8.

In addition to being oriented in a vertical position (FIG. 4) and a working horizontal position (FIG. 5), the PMP 4 can also be oriented to a starting horizontal position as depicted in FIG. 6. More specifically, with reference to FIG. 2, when a user rotates the PMP 4 a quarter turn clockwise from the vertical position, the teeth of the gear 66 and 68 will not engage with the complementary teeth 70 and 72 of the extension arms 48 and 50. Accordingly, the PMP 4 rotates but the extension arms 48 and 50 will remain in the contracted state. In this position, the PMP 4 will cover the attached speaker assembly 2, as depicted in FIG. 6. More specifically it is preferred that the speaker assembly 2 will not extend past the height or width of the PMP 4. This particular configuration is highly advantageous when the PMP 4 is not in use, or is being transported, as it allows the user to keep the attached speaker assembly 2 protected and compacted to take up less space. For embodiments where the PMP 4 can display visual data on the screen in both horizontal positions, the gear engagement with the expansion arms can readily be configured to expand when the PMP is in either horizontal orientation, if desired.

FIG. 2 will now be described in more detail, to explain a preferred means of expanding and contracting the speaker casings 26 and 28. As stated above, FIG. 2 represents a preferred embodiment when the PMP 4 is in a vertical position as shown in FIG. 4, for example. The gear 44 preferably has two toothed arcs 66 and 68. It is further preferred that the toothed arcs 66 and 68 are separated from each other by 180 degrees along the perimeter of the gear 44. It is still further preferred that each toothed arcs 66 and 68 encompasses an entire quadrant, of the gear's 44 perimeter, or substantially.

The first toothed arc 66 can be configured to engage with a complementary toothed section 70 on a first extension arm 48, while a second toothed arc 68 can be configured to engage with a complementary toothed section 72 on the second extension arm 50. The extension arms 48 and 50 each preferably include a first notch 51 and 52. The first notches 51 and 52 can be advantageously configured such that they are configured with other means for stopping the rotation of the gear 44. Any suitable means for releasably stopping, or controlling the rotation of the gear 44 can be used with the teachings herein, non-exclusively including, detents, ratchets, pawls, stops, springs, and the like, for example. In preferred embodiments leaf springs 54 and 56 can be engaged with the first notches 51 and 52, respectively, such that the extension arms 48 and 50 remain in the contracted position (as depicted in FIG. 2) in the absence of user rotation of the PMP 4. In more specific embodiments, the leaf springs 54 and 56 can be maintained in position by any suitable means, including stops 58 and 60 attached internally within the housing 14, for example.

The radius of the gear 44 can readily be adjusted to achieve the desired amount of contraction and expansion of the extension arms 48 and 50. In specific preferred embodiments, it is preferred that the gear 44 has a radius of approximately 0.72 inches to allow the extension arms 48 and 50 to extend 1 and $\frac{1}{8}^{th}$ inches. Further support means can be added to the extension arms 48 and 50, for strength purposes respectively. An example of support means can include expanding the width of the extension arms 48 and 50, utilizing rigid material, or adding additional extension arms (e.g., toothed and non-toothed) in suitable configurations, for example. Casing can also be used to house the extension arms 48 and 50, in order to protect them and for aesthetic purposes, for example.

With reference to FIG. 2, as the user rotates the PMP 4 in a counter-clockwise direction, the means for releasably stopping, or controlling the rotation of the gear 44 disengage from the first notches 51 and 52. Preferably, the extension arms 48 and 50 individually include second notches 62 and 64 that will engage with the means for releasably stopping, or controlling the rotation of the gear, after the speaker casings 26 and 28 have been expanded to their desired position; preferably, past the body of the PMP 4, the cradle 6, and the connector 8.

In further embodiments, the central gear 44 can include 1, 2, 3, or 4 indentions around the perimeter of the gear. FIG. 2 depicts a gear having 3 indentions: 80, 82, 84, where the first indention 82 is located at the top of the gear, when the PMP is in a vertical position (FIG. 4) and the second indention 80 is positioned 90 degrees clockwise from the first indention 82, and the third indention 84 is positioned 90 degrees counter-clockwise from the first indention 82. These indentions 80, 82, and 84 can be used alone or in conjunction with the other means for controlling and releasably stopping the rotation of the gear 44, described herein. The indentions are especially advantageous to prevent unintentional rotation of the PMP from a starting horizontal position (FIG. 6) to a vertical position (FIG. 4) and vice versa. With reference to FIG. 2, a user can rotate the PMP 90 degrees clockwise, thus rotating the gear 44 90 degrees clockwise such that the second indention 84 is now positioned at the top of the gear 44, where first indention 82 previously was, and the third indention 80 is now positioned at the bottom of the gear 44, 180 degrees from 82. These indentations can readily be configured to engage with other means for controlling and preventing the rotation of the gear 44, including the teeth 70 and 72 of the extension arms 48 and 50, or other stops, for example. In this position, the second and third indentation 84 and 80 prevent the gear 44 from unintentionally rotating, until the user manually rotates the PMP 4 in a counter-clockwise motion.

The first indention 82 can be used alone or in conjunction with other means (e.g., notches 51 and 52, springs 54 and 56) for preventing and controlling the expansion and contraction of the speaker casings 26 and 28 while the PMP 4 is oriented in a vertical position as depicted in FIG. 2 and FIG. 4. A fourth indention (not shown) can readily be added to the gear 44 180 degrees from the first indention 82, to further aid in controlling the rotation of the gear 44, and/or controlling the expansion and contraction of the speaker casings 26 and 28. In still other embodiments the gear can only include 2 indentions 84 and 80, for example.

The above preferred configurations generally pertain to PMPs that are wider in their horizontal orientation than their vertical orientation. For PMPs that are wider in a vertical orientation, the gear and extension arms can readily be configured to expand the speaker casings past the body of the PMP in a vertical position and contract as the PMP rotates to a horizontal position. As it is appreciated that vertical and horizontal orientations can and will be more difficult to define as PMPs adapt their user interface depending on their given orientation, it is preferred that the speaker assemblies provided herein expand as the PMP is moved to its widest orientation, and contract as the PMP is moved to its narrowest orientation. While the above embodiments generally relate to rectangular PMPs, or substantially so (e.g., having rounded corners such as the iPhone and iPod Touch) the teachings are likewise applicable to PMPs that have substantially circular, square, oval, or other non-rectangular shapes. For example, the above described means can readily be configured such that the speaker casings expand past the body of the PMP in a working or preferred configuration, and contract in another configuration, for storage and transport, regardless of the shape of the PMP.

While the speaker assemblies 2 herein are primarily advantageous when used with PMPs 4 capable of being viewed in multiple orientations, it is also expressly contemplated that they can be used with ordinary PMPs not having multiple orientations, including $5^{th}$ generation Apple iPods, and older, for example.

While the teachings herein have been primarily directed to speaker assemblies that are configured to have means that expand and contract dependent on the rotation of the PMP, it is also expressly contemplated that the speaker assemblies can include means for contracting and expanding that can be controlled independent of the PMP's rotation. According to more specific embodiments, a PMP can be secured within a rotatable cradle operably coupled to the speaker assembly, without being operably coupled to the means for contraction and expansion of the speaker casings. The cradle can include means (e.g., rotating disc, rotating shaft, or axle) for controlling the rotation including, stops, latches, notches, detents, and the like, that are not in operable connection with the means for expansion and contraction. Preferred means will be positioned on the back of the cradle, on the opposite side of the PMP.

The means for expansion and contraction that are independent of the cradle can include extension arms that include releasable locks, stops, latches, teeth, springs, hinges, detents, and the like such that a user can manually expand them when desired, regardless of the orientation of the PMP. More specifically, the speaker casings can be releasably locked in a contracted position by 1 or more releasable buttons or tabs. For example, when a user presses in on the 1 or more release buttons or tabs, the speaker casings can become unhinged, spring outward, slide outward, or be manually pulled outward.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A speaker assembly comprising:

a housing configured to utilize a power source; and one or more casings on which corresponding one or more speakers are implemented, the one or more casings configured to perform one of expansion and contraction based on an orientation of a portable media player, the one or more speakers retaining an orientation in space while the orientation of the speakers with respect to the portable media player changes based on a change in the orientation of the portable media player, the speaker assembly being releasably attached and operably coupled to the portable media player such that an audio signal can be transmitted from the portable media player to the one or more speakers.

2. The speaker assembly of claim 1, wherein means for releasably attaching to said portable media player are configured to rotate, such that a user can view the portable media player in multiple orientations.

3. The speaker assembly of claim 2, wherein means for expanding and contracting are operably coupled to said means for releasably attaching to said portable media player, such that the one or more speakers are configured to expand and contract based on the rotation of the portable media player.

4. The speaker assembly of claim 3, wherein said means for releasably attaching to said portable media player are operably coupled to a rotating central gear within the housing that is configured to expand and contract the speakers based upon clockwise or counter-clockwise rotational direction.

5. The speaker assemblies of claim 4, wherein said gear comprises two toothed quadrants positioned on opposite sides from each other and are complementary to toothed sections on extension arms coupled to said one or more speakers.

6. The speaker assembly of claim 1, wherein the expansion and contraction respectively expand the one or more speakers to a position beyond the body of the portable media player and contract the one or more speakers to a position behind the body of the portable media player.

7. The speaker assembly of claim 1, wherein an orientation of the portable media player is one of a horizontal orientation and a vertical orientation.

8. A speaker assembly comprising:

a cradle that is expanded or contracted based on an orientation of the cradle, the orientation of the cradle being in accordance with an orientation of a portable device that is capable of being physically-supported by the cradle;

a plurality of casings that expand or contract based on the orientation of the cradle, each casing including one or more speakers; and a shaft that is perpendicular to the cradle, such that the shaft is perpendicular to a display screen of the portable device when the portable device is being physically-supported by the cradle, the shaft being connected to the plurality of casings, the shaft rotating by a different amount when the cradle is rotated such that the different rotation of the shaft enables the speakers to retain an orientation in space while the orientation of the speakers with respect to the orientation of the cradle is changed.

9. The speaker assembly of claim 8, further comprising:

a gear comprising teeth that are capable of being interlocked with teeth of directionally opposite extension arms, the interlocking providing support for the speakers in each orientation of the speakers.

10. The speaker assembly of claim 8, wherein:

the portable device is being physically-supported by the cradle;

the display screen of portable device is substantially rectangular; and the display screen can display at least one of video and images in each of a vertical orientation and a horizontal orientation of the portable device, the display being enabled by rotation of the at least one of video and image in accordance with rotation of the portable device.

11. A method for configuring an orientation of a plurality of speakers in accordance with an orientation of a portable device, the method comprising:

detecting, based on a rotation of a cradle, a change in an orientation of the cradle that physically-supports the portable device, the change in the orientation of the cradle being in accordance with a change in the orientation of the portable device;

rotating, based on changing the orientation of the cradle, a shaft connected to a plurality of casings that each include one or more speakers, the rotation of the shaft being different than the rotation of the cradle; and performing, based on the different rotation of the shaft, one of expansion and contraction of a plurality of casings that each include one or more speakers, the performing of one of the expansion and the contraction enabling the speakers to retain the orientation in space while the orientation of the portable device with respect to the orientation of the cradle is changed.

12. The method of claim 11, further comprising:

interlocking, using a gear, teeth of the gear with teeth of directionally opposite extension arms such that the interlocking provides support for the speakers in each orientation of the speakers.

13. The method of claim 11, wherein the shaft is perpendicular to a display screen of the portable device.

* * * * *